US006209828B1

(12) United States Patent
Au

(10) Patent No.: US 6,209,828 B1
(45) Date of Patent: Apr. 3, 2001

(54) UNIVERSAL WATCH DISPLAY STAND

(76) Inventor: Ho Ching Au, Block A, 9/F, Goodview Inc. Building, 11 Kin Fat Street, N.T., Hong KOng (HK)

( * ) Notice: Subject to any disclaimer, the term of this patent is extended or adjusted under 35 U.S.C. 154(b) by 0 days.

(21) Appl. No.: 09/199,918

(22) Filed: Nov. 25, 1998

(51) Int. Cl.[7] ..... A47F 7/00
(52) U.S. Cl. ..... 248/116; 206/301
(58) Field of Search ..... 248/114, 115, 248/116, 229.16, 152; 211/41.1, 41.2, 85.2; 206/6.1, 307; D6/468

(56) References Cited

U.S. PATENT DOCUMENTS

D. 408,656 * 4/1999 Au ..... D6/468
3,339,745 * 9/1967 Sugerman ..... 211/85.2
4,082,183 * 4/1978 Sturm ..... 206/301
4,406,372 * 9/1983 Bell ..... 206/566
5,181,608 * 1/1993 Herzog ..... 206/301
5,660,284 * 8/1997 Vaughn ..... 211/41.1
5,762,184 * 6/1998 Greiner ..... 206/6.1

* cited by examiner

*Primary Examiner*—Anita M. King
(74) *Attorney, Agent, or Firm*—Raymond Y. Chan; David and Raymond Patent Group

(57) ABSTRACT

A universal watch display stand includes a base and a holder. The holder includes at least a supporting rib upwardly extended from said base, and a plurality of holding wings spacedly and transversely supported by the supporting rib so as to define a plurality of holding slots between the holding wings respectively. Accordingly, a leather belt-type watch can be displayed 3-dimensionally by mounting on the holder but will not leave any pressed mark on or damage the leather belt.

14 Claims, 5 Drawing Sheets

UNIVERSAL WATCH DISPLAY STAND

FIELD OF THE PRESENT INVENTION

The present invention relates to watch display stands, and more particularly to a universal watch display stand specifically designed for leather belt-type watch, wherein the universal watch display stand enables a leather belt-type watch of any size to be displayed 3-dimensionally likes a metal link wrist watch without the need to buckle up the leather belt.

BACKGROUND OF THE PRESENT INVENTION

Wristwatch basically is classified into two major kinds, namely the leather belt-type watch and the metal link-type watch.

The metal link-type watch comprises a watch body and an endless metal link circularly extending from one side of the watch body to another side of the watch body. The metal link contains a fast buckle for fastening the metal link-type watch on the user's wrist. To display the metal link-type watch, it is fastened on a cushion pad or rod, and supported in upright position. Moreover, it is easier to store the metal link-type watch in a box while fastening on the cushion pad or rod.

The leather belt-type watch also comprises a watch body and a first and a second belt piece connected to two sides of the watch body respectively. A buckle head is connected to a free end of the first belt piece while a plurality of fastening holes are provided along the second belt piece. To fasten the leather belt-type watch on the user's wrist, the first belt piece and the second belt piece must be buckled up together.

The best and most natural way to display a watch is to display it 3-dimensionally, as if it is worn on a user's wrist. Since the metal link-type watch is easy to fasten circularly on a cushion pad, it provides a potential customer a more reality of how it looks like after wearing on wrist. Of course, a leather belt can also be fastened on a cushion pad and displayed as if the metal link-type watch 3-dimensionally by buckling up the two belt pieces. However, the buckle head will leave a permanent pressed mark on the second belt piece. No body can accept to purchase a new watch with pressed mark thereon. Therefore, all the leather belt-type watches can be merely displayed or stored lying flat in a box or on table.

SUMMARY OF THE PRESENT INVENTION

The main object of the present invention is to provide a universal watch display stand which enables a leather belt-type watch to display 3-dimensionally but will not leave any pressed mark on or damage the leather belt.

Another object of the present invention is to provide a universal watch display stand which can firmly hold a leather belt-type watch in circular shape without buckling up the two belt pieces.

Another object of the present invention is to provide a universal watch display stand which does not employ complicate structure and has minimized components, so as to minimize the manufacturing cost and assembly labor.

Accordingly, in order to accomplish the above objects, the present invention provides a universal watch display stand which comprises a base and a holder. The holder comprises at least a supporting rib upwardly extended from said base, and a plurality of holding wings spacedly and transversely supported by the supporting rib so as to define a plurality of holding slots between the holding wings respectively. In order to mount a leather belt-type watch on the universal watch display stand, first, place a watch body of the leather belt-type watch on a front side of the holder; second, rearwardly penetrate a first belt piece and a second belt piece of the leather belt-type watch through an upper holding slot and a lower holding slot of the holder respectively until two free ends of the first and second belt pieces reach a rear side of the holder; fourth, downwardly bend the free end of the first belt piece and insert the free end of the first belt piece into one of the holding slots positioned lower than the upper holding slot; and fifth, upwardly bend the free end of the second belt piece and insert the free end of the second belt piece into one of the holding slots positioned upper than the lower holding slot.

DETAILED DESCRIPTION OF THE PREFERRED EMBODIMENT

Referring to FIGS. 1 to 4, a universal watch display stand according to a preferred embodiment of the present invention is illustrated, which comprises a base 10 and a holder 20.

Figure 1:
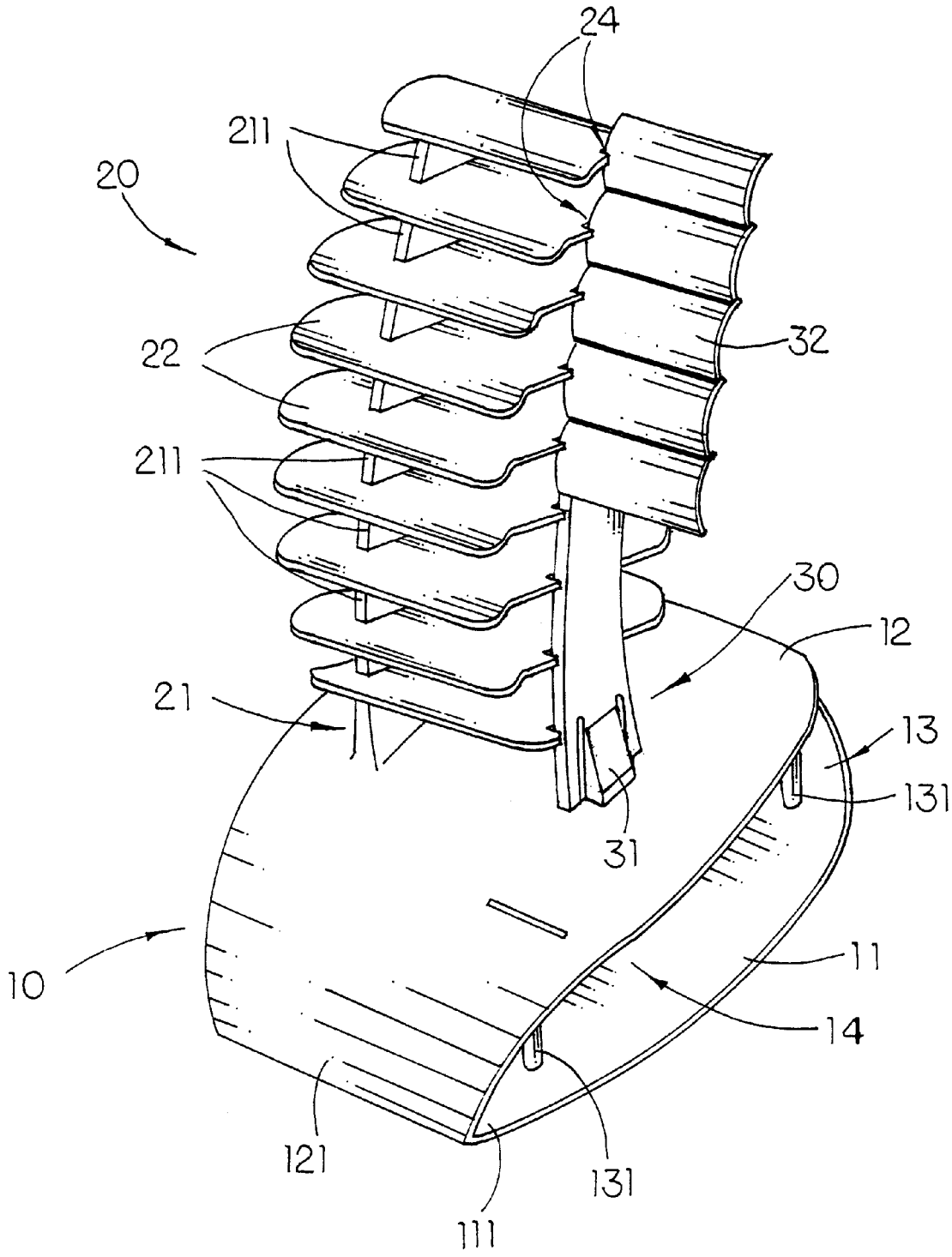
FIG. 1 is a perspective view of a universal watch display stand according to a preferred embodiment of the present invention.
Figure 3:
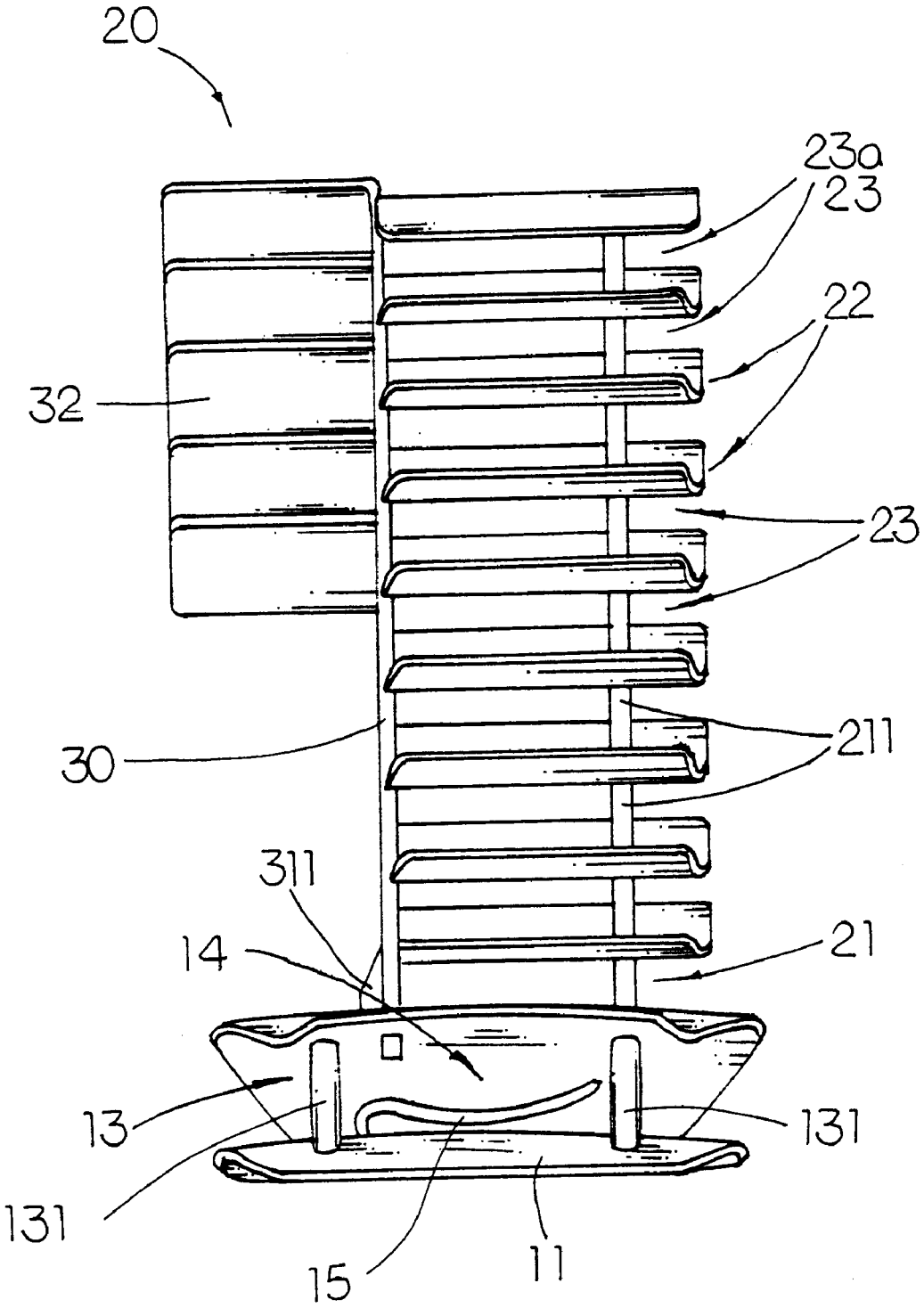
FIG. 3 is a rear view of the universal watch display stand according to the above preferred embodiment of the present invention.
Figure 4:
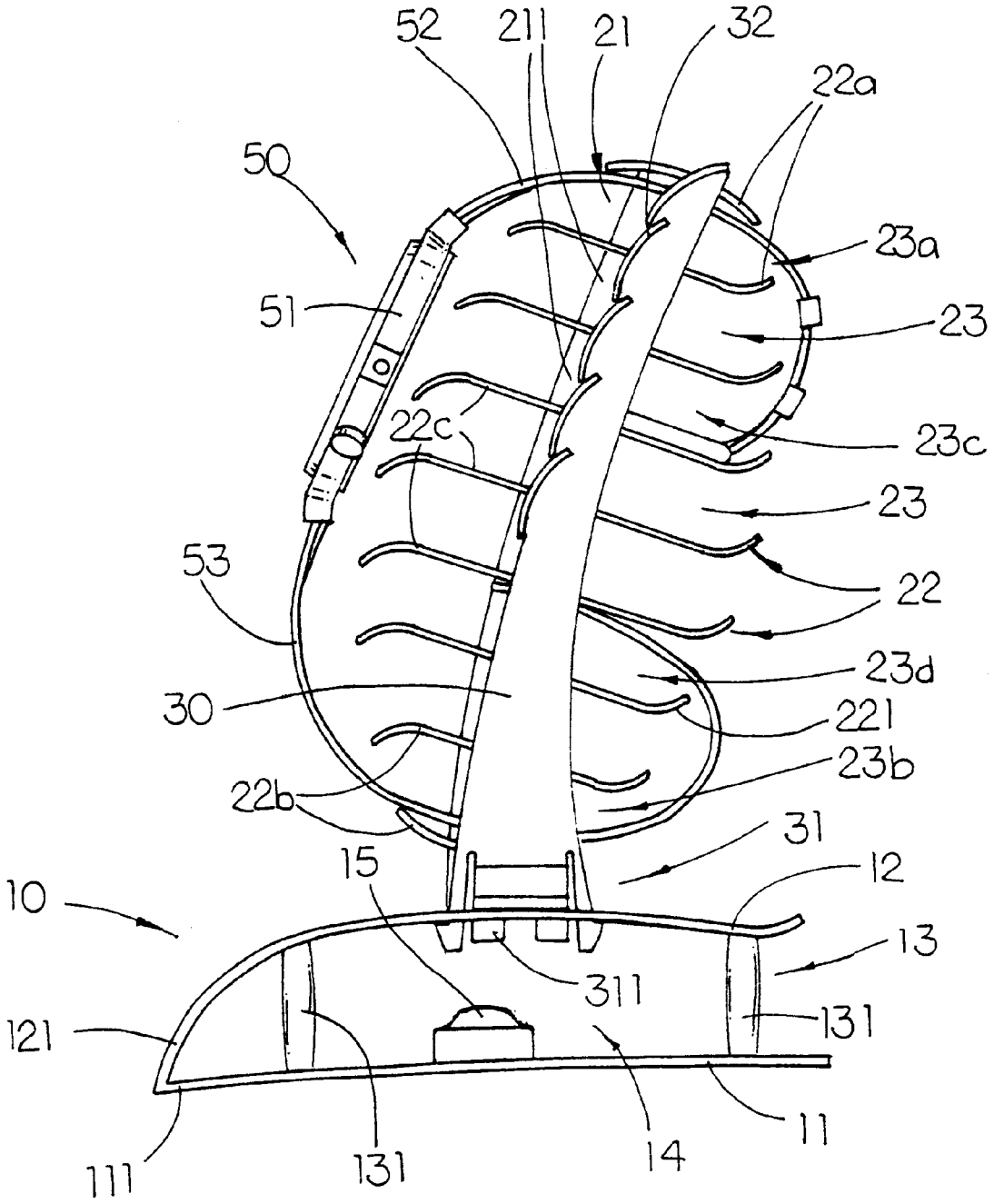
FIG. 4 is a side view universal watch display stand according to the above preferred embodiment of the present invention, illustrating a leather belt-type watch mounted on the universal watch display stand.

As shown in FIGS. 1, 3 and 4, the base 10 comprises a bottom layer 11, a top layer 12, and a connecting means 13 to integrally support the top layer 12 above the bottom layer 11 so as to define a receiving cavity 14 between the bottom layer 11 and the top layer 12. Inside the receiving cavity 14, a L-shaped holding clip 15 is integrally affixed on the bottom layer 11, as shown in FIGS. 3 and 4, for holding the certificate and direction menu of the displaying watch within the receiving cavity 14.

In order to provide the base 10 with a smooth front surface, a front side 121 of the top layer 12 is downwardly extended to integrally connect with a front side 111 of the bottom layer 11. The connecting means 13 comprises a plurality of supporting posts 131 vertically and spacedly connected between the bottom layer 11 and the top layer 12.

The holder 20 comprises at least a supporting rib 21 and a plurality of holding wings 22. The supporting rib 21 is extended upwardly and rearwardly from the top layer 12 of the base 10. The holding wings 22 are spacedly and transversely supported by the supporting rib 21 in layers manner, so as to define a plurality of holding slots 23 between the holding wings 22 respectively.

Figure 5:
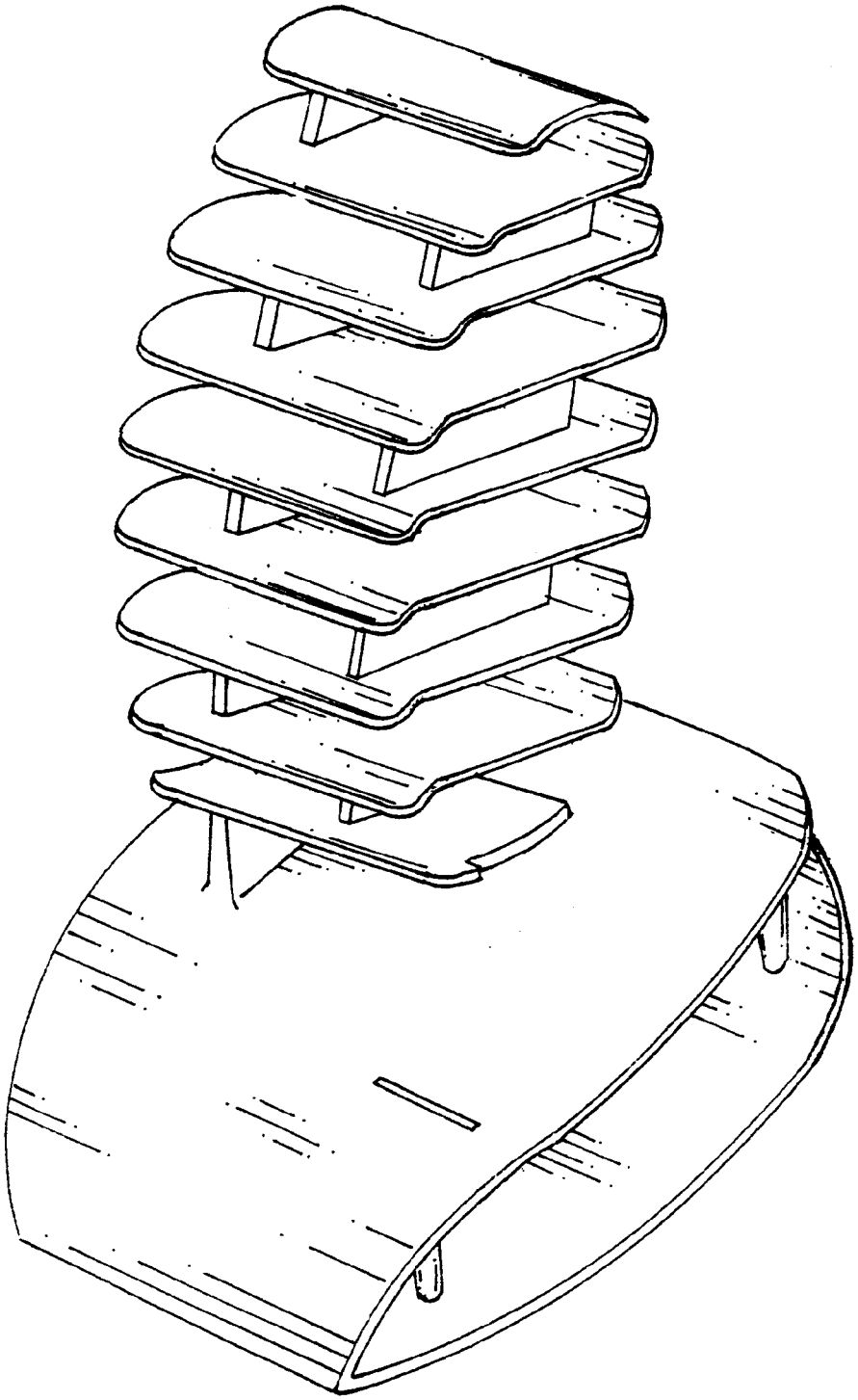
FIG. 5 is a perspective view of an alternative mode of the universal watch display stand according to the above preferred embodiment.

The base 10, the supporting rib 21 and the holding wings 22 are integrally made in one body form by mold injection. Accordingly, the supporting rib 21 is divided into a plurality of rib pieces 211 extended between the plurality of holding wings 22 respectively. According to the preferred embodiment, the plurality of rib pieces 211 are aligned along a common axis and positioned near the outer ends of the holding wings 22, as shown in FIGS. 1 to 4. Of course, it is apparent to alternatively dispose the rib pieces 211 between the holding wings 22 in different position, as shown in FIG. 5.

In order to provide the holder 20 with an ellipsoidal shape when viewing sidewardly, as shown in FIG. 4, the upper holding wings 22*a* and the lower holding wings 22*b* respectively have a shorter width while the middle holding wings 22*c* respectively have a longer width. Moreover, except the uppermost and the lowermost holding wings 22, a front side of each of the holding wings 22 is bent downwards while a rear side of each of the holding wings 22 is bent upwards to form a curved guiding edge 221.

Figure 2:
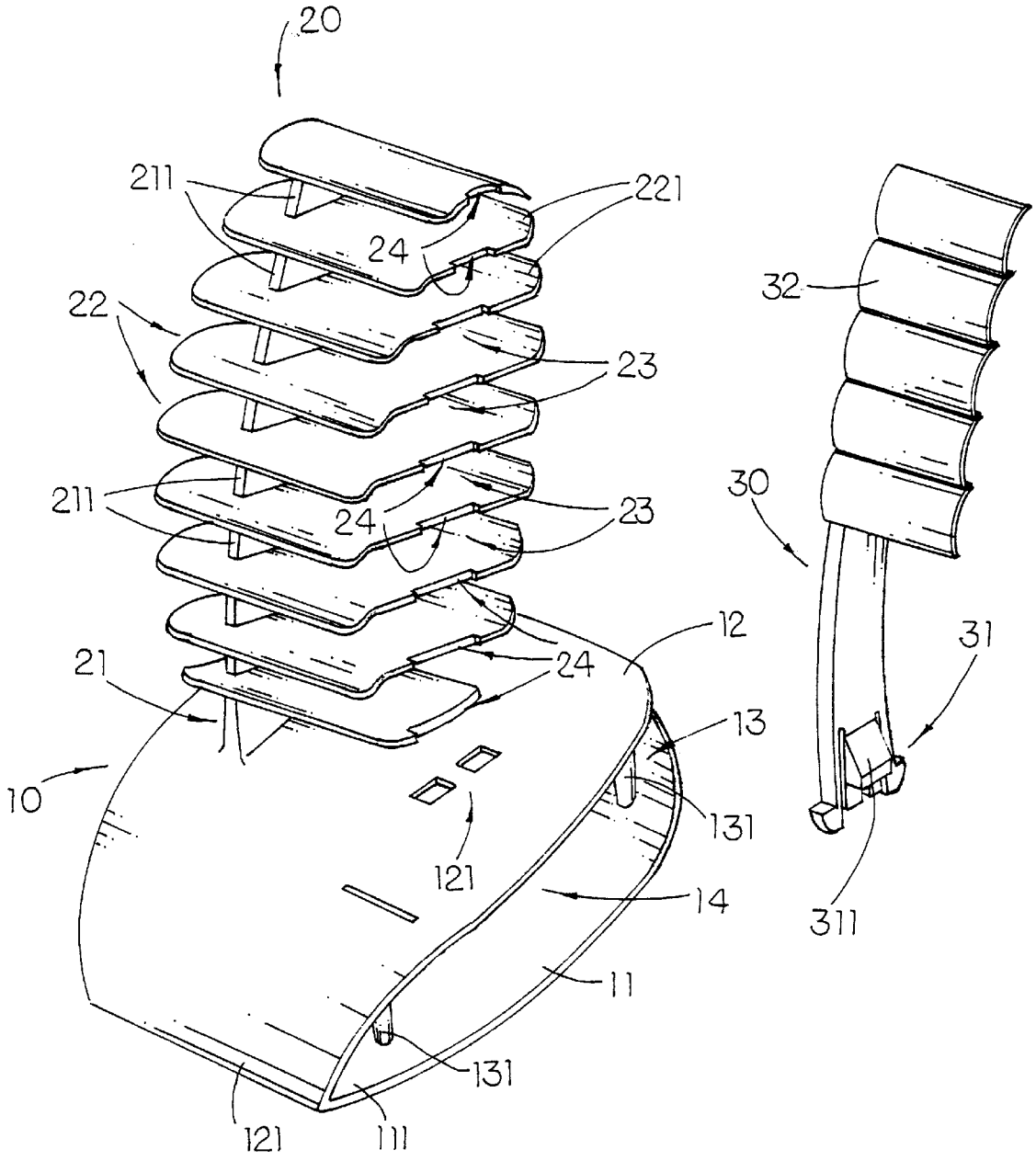
FIG. 2 is an exploded perspective view of the universal watch display stand according to the above preferred embodiment of the present invention.

The universal watch display stand of the present invention further comprises a locking bar 30 detachably attached to an inner side of the holder 20 so as to bar the plurality of holding slots 23 formed between the holding wings 22. As shown in FIGS. 1 and 2, an inner end of each of the holding wings 22 has an indented slot 24 provided at a middle position thereof. The widths of the indented slots 24 of the upper holding wings 22 are smaller than the widths of the indented slots 24 of the lower holding wings 22. The locking bar 25 has a predetermined width gradually increasing along the locking bar 30 downwardly with respect to the widths of the indented slots 24. The locking bar 30 is adapted to extend along and engage in the indented slots 24 so as to bar the holding slots 23. Therefore, each of the holding slots 23 is limited to the space between the supporting rib 21 and the locking bar 30.

The universal watch display stand also comprises a locking means 31 for firmly locking the locking bar 30 in position. As shown in FIG. 2, the locking means 31 comprises a locking buckle 311 which is integrally form at a bottom end of the locking bar 25 and the top layer 12 of the base 10 also provides a pair of locking slots 121 adapted for the locking buckle 311 to insert therein in order to firmly fasten the locking bar 30 in such an upwardly extending position, as shown in FIG. 4.

A display plate 32 is attached in front of the locking bar 30 for displaying information of the watch to be displayed by this universal watch display stand.

As shown in FIG. 4, to mount a belt-type watch 50 having two belt pieces 52, 53 made of leather or plastic on the universal watch display stand:

First, place a watch body 51 of the belt-type watch 50 on a front side of the holder 20.

Second, rearwardly penetrate the first belt piece 52 and a second belt piece 53 of the leather belt-type watch through an upper holding slot 23*a* and a lower holding slot 23*b* of the holder 20 respectively until two free ends of the first and second belt pieces 52, 53 reach a rear side of the holder 20.

Third, downwardly bend the free end of the first belt piece 52 and insert the free end of the first belt piece 52 into one of the holding slots 23*c* positioned lower than the upper holding slot 23*a*.

Fourth, upwardly bend the free end of the second belt piece 53 and insert the free end of the second belt piece 53 into one of the holding slots 23*d* positioned upper than the lower holding slot 23*b*. The rebounding force of the bended first and second belt pieces 52, 53 will make the free ends of the first and second belt pieces 52, 53 pressing against the adjacent holding wings 22 respectively, so that the displaying watch 50 will be firmly mounted 3-dimensionally on the holder 20.

Alternatively, the user may initially detach the locking bar 30 to open the holding slots 23 so that the first and second belt pieces 52, 53 can be simply slid into the respective holding slots 23*a*, 23*c*, 23*b*, 23*d*. After mounting the watch 50 circularly around the holder 20, as shown in FIG. 4, refasten the locking bar 30 in position to bar the holding slots 23 in order to prevent the watch 50 from slipping out again. In which, the guiding edges 221 of the holding wings not only can guide the free ends of the first and second belt pieces 52, 53 to insert into the holding slots 23, but also can prevent the free ends of the belt pieces 52, 53 from accidentally withdrawing out of the holding slots 23.

Moreover, the user merely needs to detach the locking bar 30, and then he or she may easily take out the displaying watch 50. According to the present invention as disclosed above, the belt-type watch can be mounted circularly and displayed in upright position for illustrating to the potential purchaser of the actual condition of the watch like wearing on a user's wrist. However, by means of the universal watch display stand, the two belt pieces 52, 53 have no need to buckle up so that no pressed mark will be left on the belt piece 53. The user is free to use the same size of the universal watch display stand of the present invention for all sizes of different watches. For example, a smaller size watch can use two holding slots 23 which are closer to each other to mount the two belt pieces 52, 53. The present invention is an ideal device for displaying a belt-type watch. For storage, the watch retailer can simply put the whole display stand with the watch in a box.

Besides, it is worth to mention that although the universal watch display stand of the present invention is more specifically for the belt-type watch, the metal link-type watch substantially can also use the present invention to display.

What is claimed is:

1. A universal watch display stand, comprising a base;

a holder which comprises a plurality of holding wings spacedly and transversely arranged in layers so as to define a plurality of holding slots between said holding wings respectively, wherein said holding wings which are located in an upper position of said holder have shorter widths and said holding wings which are located in a lower position have longer widths, wherein a front side of each of said holding wings is bent downwards while a rear side of each of said holding wings is bent upwards to form a curved guiding edge; and a supporting means adapted for supporting said holder on top of said base, comprising at least a supporting rib extended upwardly from said base to support said holding wings of said holder, wherein said supporting rib is divided into a plurality of rib pieces extended between said plurality of holding wings respectively.

2. A universal watch display stand, as recited in claim 1, further comprising a locking bar detachably attached to an inner side of said holder so as to bar said plurality of holding slots formed between said holding wings, wherein an inner end of each of said holding wings has an indented slot provided at a middle position thereof, and said locking bar adapted to extend along and engage in said indented slots so as to bar said holding slots, so that each of said holding slots is limited to a space between said supporting rib and said locking bar.

3. A universal watch display stand, as recited in claim 2, further comprising a locking means for firmly locking said locking bar in position, wherein said locking means comprises a locking buckle which is integrally form at a bottom end of said locking bar and a top layer of said base provides a pair of locking slots for inserting said locking buckle therein in order to firmly fasten said locking bar in an upwardly extending position.

4. A universal watch display stand, as recited in claim 3, wherein said base further comprises a bottom layer and a connecting means for integrally supporting said top layer above said bottom layer so as to define a receiving cavity between said bottom layer and said top layer, wherein inside said receiving cavity, a L-shaped holding clip is integrally affixed on said bottom layer.

5. A universal watch display stand, as recited in claim 4, wherein a display plate is attached on said locking bar.

6. A universal watch display stand, comprising a base;

a holder which comprises a plurality of holding wings spacedly and transversely arranged in layers to define a plurality of holding slots between said holding wings respectively, wherein said holding wings which are located in upper position have a shorter width and said holding wings which are located in lower position have a longer width, wherein a front side of each of said holding wings is bent downwards while a rear side of each of said holding wings is bent upwards to form a curved guiding edge; and a supporting means adapted for supporting said holder on top of said base, comprising at least a supporting rib extended upwardly from said base to support said holding wings of said holder.

7. A universal watch display stand, comprising a base;

a holder which comprises a plurality of holding wings spacedly and transversely arranged in layers to define a plurality of holding slots between said holding wings respectively, wherein a front side of each of said holding wings is bent downwards while a rear side of each of said holding wings is bent upwards to form a curved guiding edge; and a supporting means for supporting said holder on top of said base.

8. A universal watch display stand, comprising a base;

a holder which comprises a plurality of holding wings spacedly and transversely arranged in layers to define a plurality of holding slots between said holding wings respectively;

a supporting means for supporting said holder on top of said base; and a locking bar detachably attached to an inner side of said holder so as to bar said plurality of holding slots formed between said holding wings, wherein an inner end of each of said holding wings has an indented slot provided at a middle position thereof, and said locking bar adapted to extend along and engage in said indented slots so as to bar said holding slots, so that each of said holding slots is limited to a space between said locking bar and a supporting rib extended upwardly from said base to support said holding wings.

9. A universal watch display stand, as recited in claim 8, further comprising a locking means for firmly locking said locking bar in position.

10. A universal watch display stand, as recited in claim 9, wherein said locking means comprises a locking buckle which is integrally form at a bottom end of said locking bar and a top layer of said base provides a pair of locking slots adapted for said locking buckle to insert therein in order to firmly fasten said locking bar in such an upwardly extending position.

11. A universal watch display stand, comprising a base;

a holder which comprises a plurality of holding wings spacedly and transversely arranged in layers to define a plurality of holding slots between said holding wings respectively;

a supporting means adapted for supporting said holder on top of said base, which comprises at least a supporting rib extended upwardly from said base to support the holding wings; and a locking bar detachably attached to an inner side of said holder so as to bar said plurality of holding slots formed between said holding wings, wherein an inner end of each of said holding wings has an indented slot provided at a middle position thereof, and said locking bar adapted to extend along and engage in said indented slots so as to bar said holding slots, so that each of said holding slots is limited to a space between said supporting rib and said locking bar.

12. A universal watch display stand, as recited in claim 11, further comprising a locking means for firmly locking said locking bar in position.

13. A universal watch display stand, as recited in claim 12, wherein said locking means comprises a locking buckle which is integrally form at a bottom end of said locking bar and a top layer of said base provides a pair of locking slots adapted for said locking buckle to insert therein in order to firmly fasten said locking bar in such an upwardly extending position.

14. A universal watch display stand, comprising a base comprising a bottom layer, a top layer, and a connecting means to integrally support said top layer above said bottom layer to define a receiving cavity between said bottom layer and said top layer, wherein inside said receiving cavity, a L-shaped holding clip is integrally affixed on said bottom layer;

a holder which comprises a plurality of holding wings spacedly and transversely arranged in layers to define a plurality of holding slots between said holding wings respectively; and a supporting means for supporting said holder on top of said base.

* * * * *